US007036481B2

(12) United States Patent
Sailer et al.

(10) Patent No.: US 7,036,481 B2
(45) Date of Patent: May 2, 2006

(54) SWITCHING ELEMENT FOR A VALVE DRIVE OF AN INTERNAL COMBUSTION ENGINE

(75) Inventors: Peter Sailer, Erlangen (DE); Lutz Müller, Dachsbach (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/072,704

(22) Filed: Mar. 4, 2005

(65) Prior Publication Data

US 2005/0152797 A1 Jul. 14, 2005

Related U.S. Application Data

(63) Continuation of application No. PCT/EP2003/010445, filed on Sep. 19, 2003.

(30) Foreign Application Priority Data

Sep. 27, 2002 (DE) ..... 102 45 301

(51) Int. Cl.
*F01L 1/34* (2006.01)
*F01L 1/14* (2006.01)
*F02D 13/06* (2006.01)

(52) U.S. Cl. ..... 123/198 F; 123/90.16; 123/90.55

(58) Field of Classification Search ..... 123/90.15, 123/90.16, 90.43, 90.46, 90.55, 90.56, 90.57, 123/90.58, 90.59, 198 F
See application file for complete search history.

(56) References Cited

U.S. PATENT DOCUMENTS 5,782,216 A 7/1998 Haas et al. ..... 123/90.16
6,321,704 B1 11/2001 Church et al. ..... 123/90.16
6,401,676 B1 6/2002 Tsukui ..... 123/90.16
6,497,207 B1 12/2002 Spath et al. ..... 123/90.16
6,513,472 B1 * 2/2003 Speil et al. ..... 123/90.16
6,578,535 B1 * 6/2003 Spath et al. ..... 123/90.16
6,595,174 B1 * 7/2003 Schnell ..... 123/90.55
6,606,972 B1 * 8/2003 Wenisch et al. ..... 123/90.16
2002/0046718 A1 4/2002 Spath et al. ..... 123/90.15
2002/0096139 A1 7/2002 Zheng ..... 123/198 F
2002/0195072 A1 * 12/2002 Spath et al. ..... 123/90.16

(Continued)

FOREIGN PATENT DOCUMENTS

DE 42 06 166 9/1992

(Continued)

*Primary Examiner*—Willis R. Wolfe, Jr.
(74) *Attorney, Agent, or Firm*—Volpe and Koenig, P.C.

(57) ABSTRACT

A switching element (1) for a valve drive of an internal combustion engine is provided, preferably for deactivating a valve. The switching element has an outer section (2), in addition to an inner element (4) that can be axially displaced in a bore (3) of the outer section. The outer section (2) and the inner element (4) are displaced away from one another by action of lost-motion spring elements (5) and can be coupled together in an axially-distant relative position, whereby at least one piston (6), which is situated in a bore (7) that runs transversally through the inner element (4), acts as a coupling element. An annular groove (8), into which the piston (6) can be partially displaced to adopt its coupling position, is located in the bore (3) of the outer section (2). At least some sections of an underside (9) of the piston (6) have a flat transversal surface (11), which leads from a outer radial end face (10) of the piston and acts as a contact zone for an opposing annular surface (12) of the annular groove (8), and the piston is held in the inner element (4) by a rotational lock (13). Stop elements (15) are allocated to an inner radial end face (14) of the piston (6) for an uncoupling position of the piston, and the rotational lock (13) and the stop elements (15) are formed from one component.

7 Claims, 2 Drawing Sheets

U.S. PATENT DOCUMENTS

| | | | | |
|---|---|---|---|---|
| 2003/0075129 | A1 | 4/2003 | Spath et al. | 123/90.16 |
| 2003/0101953 | A1 | 6/2003 | Hendriksma et al. | 123/90.16 |
| 2003/0196620 | A1* | 10/2003 | Spath | 123/90.16 |
| 2005/0045132 | A1* | 3/2005 | Hendriksma et al. | 123/90.16 |

FOREIGN PATENT DOCUMENTS

| | | |
|---|---|---|
| DE | 42 38 325 | 5/1994 |
| EP | 0 608 925 | 8/1944 |
| WO | WO 91/12415 | 8/1991 |

* cited by examiner

SWITCHING ELEMENT FOR A VALVE DRIVE OF AN INTERNAL COMBUSTION ENGINE

CROSS-REFERENCE TO RELATED APPLICATIONS

This application is a continuation of PCT/EP2003/010445, filed Sep. 19, 2003, which is incorporated by reference as if fully set forth.

BACKGROUND

The invention relates to a switching element for a valve drive of an internal combustion engine, preferably for deactivating a valve. Said element comprises an outer section, in addition to an inner element that can be axially displaced in the bore of the outer section. According to the invention, the outer section and the inner element are displaced away from one another by the action of lost-motion spring elements and can be coupled together in an axially-distant relative position, whereby at least one piston, which is situated in a bore that runs transversally through the inner element, is applied as the coupling element. An annular groove, into which the piston can be partially displaced to adopt its coupling position, is provided in the bore of the outer section. Some sections of the underside of the piston have a flat transversal surface, which leads from the outer radial end face of the piston and acts as a contact zone for an opposing annular surface of the annular groove and the piston is held in the inner element by means of a rotational lock. Stop elements are allocated to an inner radial end face of the piston for the uncoupling position of the latter.

Such a switching element, here embodied as a roller tappet for a push rod drive, is known from U.S. Pat. No. 6,321,704, FIG. 6, which is considered to be a category-defining invention. An annular groove, in which a securing ring runs, is arranged in the outer casing of the inner element of the switching element. In the region of a radial bore for the shown two pistons intersecting the outer casing of the inner element, as coupling elements the securing ring engages under a flattened underside of the piston. This securing ring is used as a rotational lock for the piston in its radial bore in the inner element, whereby an allocation of its flat underside to the annular groove in the outer section is guaranteed in the coupling case.

A recess, which carries a ring-shaped element for defining a stop for the inner radial piston, is also formed in the middle in the radial bore.

Several disadvantages are inherent in the previously mentioned configuration. For example, according to processing, significant residual burrs remain in the region of an outlet of the annular groove on the outer casing of the inner element in the section of the radial bore. These must be removed, which is expensive. Simultaneously, it is clear to someone skilled in the art that the total production of two annular grooves for the rotational lock as well as the inner radial stop requires additional expense.

In addition, the previously mentioned document presents no measures like preventing processing-specific tolerance problems and symmetry errors with simple means.

SUMMARY

Therefore, the object of the invention is to create a switching element of the previously mentioned class, which overcomes the cited disadvantages through simple means.

According to the invention, this problem is solved forming the rotational lock and the stop elements from one component. An especially preferred embodiment of the invention provides that the component comprises at least one engagement body, like a needle, which runs in the circumferential direction offset relative to the bore in the inner element and which projects inwards into the bore and thus forms on one hand the stop elements for the inner radial end face of the one or more pistons, wherein, on the other hand, this inner radial end face has a recess complementary to this needle as a rotational lock, at least on the side of the needle.

Thus, a switching element is provided, for which the disadvantages cited in the introduction are overcome through simple means. The rotational lock with stop elements finally combined into one component (in interaction with the inner radial end faces embodied according to the invention) can be manufactured and mounted simply and reduces the manufacturing costs in comparison with the state of the art described in the introduction.

Instead of the proposed needle, obviously other engagement bodies commonly known to someone skilled in the art, like balls or the like, can be applied.

Advantageously, the one or more needles are arranged offset by 180° to the radial bore, wherein it is especially advantageous to arrange two diametrically opposite needles, which prevents tipping of the corresponding pistons in the radial bore by overlapping of the needles.

According to the invention, it is also possible to shape the recess on the inner radial end face of the corresponding piston with reference to an outer casing of the associated needle, such that when the piston is displaced completely inwards radially, the recess surrounds the needle in a complementary way but obviously with clearance. Thus, symmetry errors and tolerances specific to processing of the components can be compensated.

It is still to be mentioned that an extremely cost-effective mass-produced part, such as a needle for a needle bearing or the like, can be used, for example, as the needle. This is advantageously inserted into a corresponding recess of the inner element.

In addition, it is especially advantageous when two diametrically opposite pistons are provided in the bore of the inner element formed as a radial bore. Thus, tipping of the inner element relative to the outer element does not have to be taken into consideration during coupling and simultaneously there is only a relatively low surface pressure in this area.

In one preferred embodiment of the invention, the module is embodied such that when the one or more pistons are displaced into their uncoupling positions, directly before one end of its engagement in the annular groove of the outer section, the recess at least already slightly encompasses the needle. Thus, directly before a "loss" of guidance of the corresponding piston, due to the lack of contact of its transversal surface to the annular surface of the annular groove, its further directed guidance into the uncoupling position is guaranteed.

Obviously, instead of the especially advantageous two pistons as coupling elements, also a greater number can be arranged.

In another preferred embodiment of the invention, the piston is displaced radially outwards, thus in its coupling position, by means of the force of at least one mechanical spring element, such as a helical pressure spring or the like. At this point other displacement elements of mechanical, hydraulic, or magnetic structural type should also occur to someone skilled in the art without a detailed discussion being required here. Displacement into the uncoupling position of the coupling elements is preferably provided by means of hydraulic pressure using a method and means not described in more detail here.

It is also proposed in the configuration of the invention to arrange the inner element without any other rotational lock or guidance, thus it is able to rotate freely, in the outer section. These elements are particularly useful in accordance with one embodiment of the invention, because due to the annular groove making a complete revolution in the bore of the outer section, positional allocation of the piston to the outer section is not necessary.

A similarly particularly important feature of the invention is the subject matter of another subordinate claim. Accordingly, the outer end face of the one or more pistons should be formed complementary to the bore of the inner element. Thus, the corresponding piston is "fed" to the annular groove in the outer section in a guided, rotationally locked, and also driven way projecting into the bore of the outer section for the relative stroke of the inner element to the outer section. This guidance is especially precise.

According to another aspect of the invention, the switching element should be formed, for example, as a cam follower in a push rod drive. It is conceivable to form the switching element, e.g., as a roller cam follower. However, an application at an arbitrary section of the push rod drive is also conceivable and provided. However, it is expressly mentioned at this point that the switching element can also be formed as a switchable cup tappet, a switching support element for tow bar gears or as an insert element for finger lever cam followers or can be integrated at any desired point in a driving way into the valve drive.

BRIEF DESCRIPTION OF THE DRAWINGS

The invention is described in more detail preferably with reference to the drawings. In the drawings.

DETAILED DESCRIPTION OF THE PREFERRED EMBODIMENTS

Figure 1:
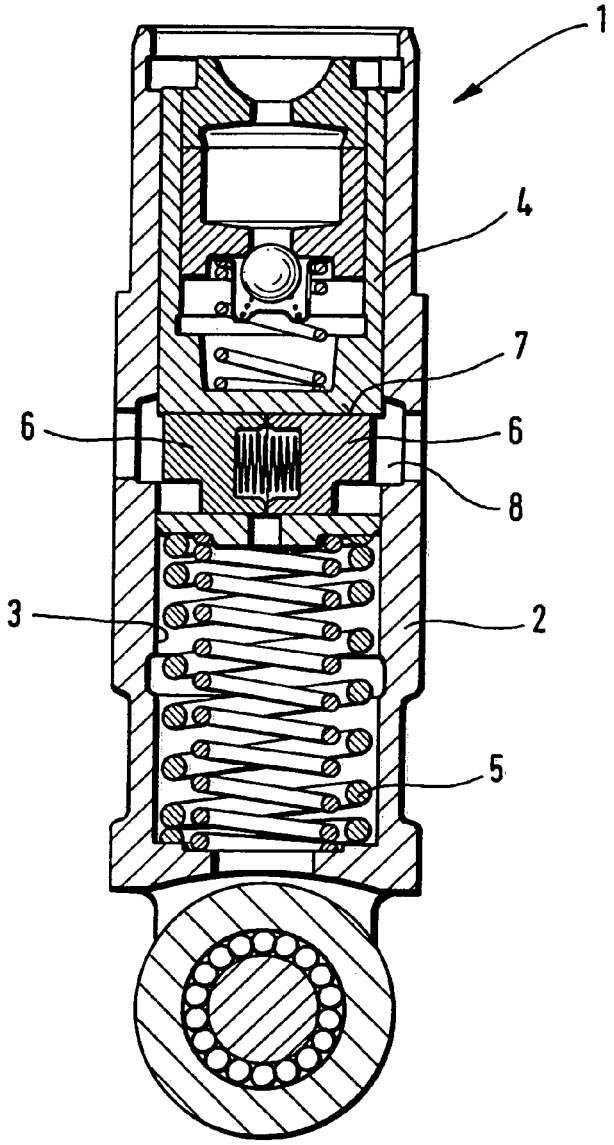
FIG. 1 is a cross-sectional view of a switching element formed as a roller tappet.
Figure 2:
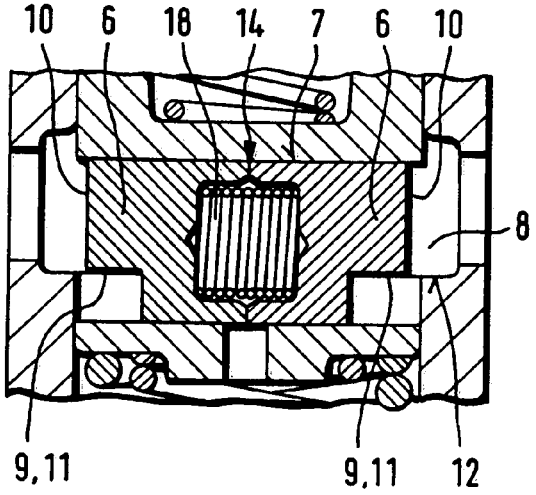
FIGS. 2 and 3 are views showing enlarged representations of the switching element from FIG. 1 in the region of its piston.
Figure 3:
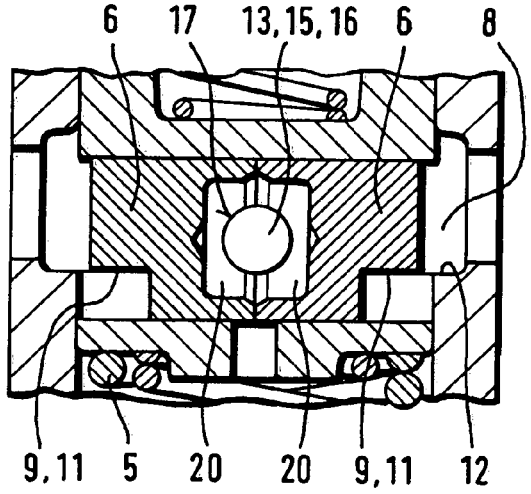

The figures present a switching element 1 for a valve drive of an internal combustion engine, which can be used for deactivating the valve.

It comprises an outer section 2, which possesses a pocket-like bore 3. An inner element 4 runs in the bore 3. Between the outer section 2 and the inner element 4 there are lost-motion spring elements 5, which do not have to be described in more detail at this point.

A bore 7 extends radially through the inner element 4. Two diametrically opposite pistons 6 sit in the bore 7 as coupling elements. These are forced radially outwardly by the force of a helical spring 18.

This helical spring 18 extends with its end 19 in a pocket hole 20 at a corresponding inner radial end face 14.

Some sections of the underside 9 of each piston 6 have a flat transversal surface 11, which leads from the outer radial end face 10. This transversal surface 11 acts as a contact zone for an opposing annular surface 12 of an annular groove 8 in the bore 3 of the outer section 2. For a desired coupling of the inner element 4 to the outer section 2, when pressure of the hydraulic elements before the end face 10 is deactivated, the piston 6 travels in the annular groove 8 and thus lies with the transversal surface 11 on the annular surface 12 of the annular groove 8.

A needle 16 is arranged orthogonal to the bore 7 in the inner element 4 in this bore. It projects here centrally in the bore 7. Advantageously, two diametrically opposite needles 16 are provided. Here, each needle 16 is fixed, for example, by a simple insertion process in a corresponding support of the inner element 4.

Figure 4:
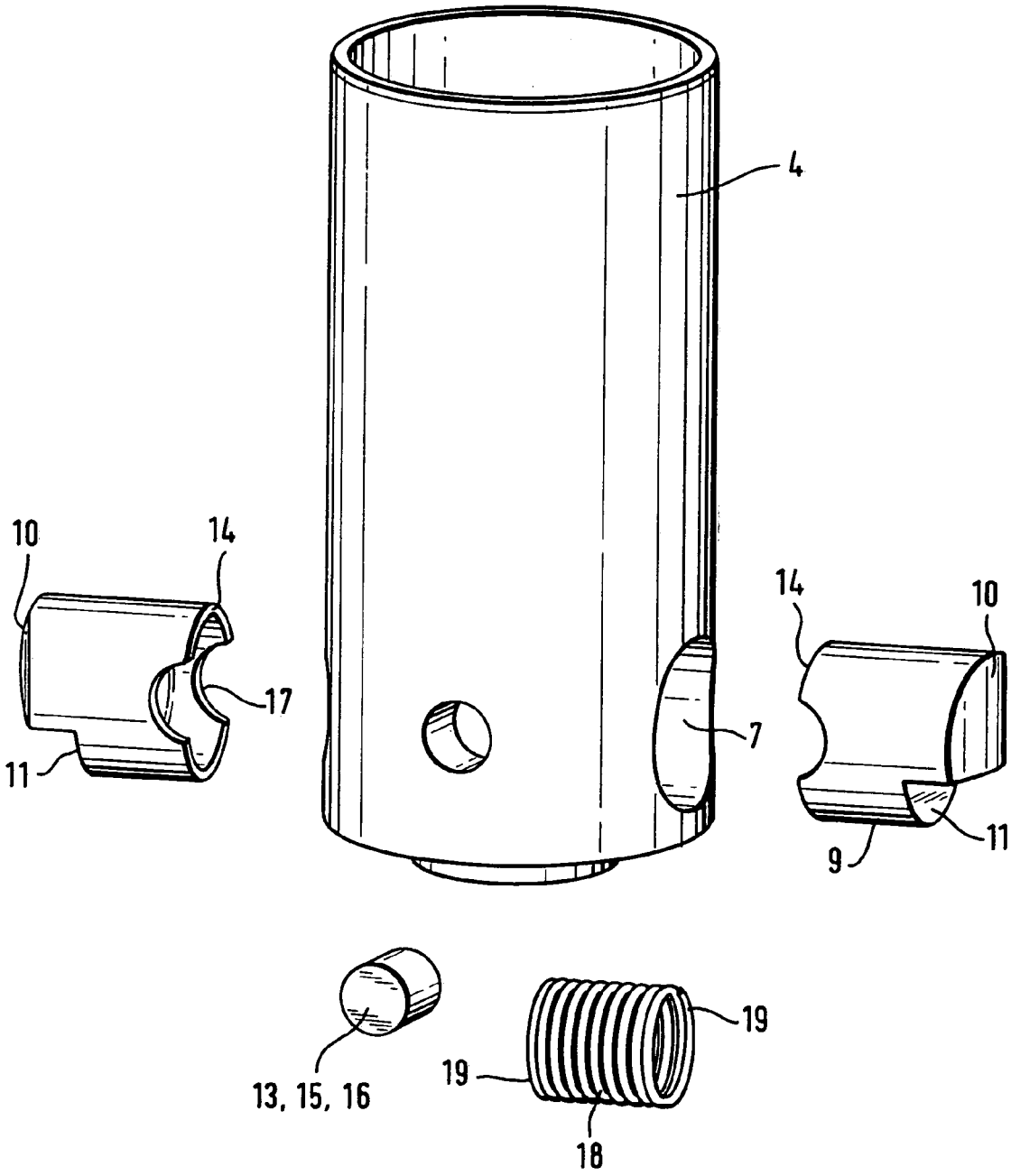
FIG. 4 is a three-dimensional perspective view, partially exploded, of the inner element with additional components.

As follows especially from FIG. 4, the corresponding pistons 6 have at their inner radial face 14 semi-circular recesses 17. These are formed complementary to an outer casing of the needles 16, wherein they surround the needles 16 with clearance in the complete uncoupling position of the pistons 6. Through this imprecise guidance, symmetry and tolerance errors of the corresponding components can be compensated using a simple method and means.

All in all, a rotational lock 13 for the piston 6 and central stop elements 15 for this piston are formed in one module simultaneously by means of the needles 16. Additional components or manufacturing means, as in the state of the art mentioned in the introduction, can be eliminated. Simultaneously, the deburring expense due to the elimination of the "outer" annular groove for the locking ring is also eliminated.

The component 13, 15 is formed such that when the piston 6 is displaced radially inwards for the uncoupling purpose, at the end of its engagement in the annular groove 8 of the outer section 2, its recesses 17 at least already slightly surround the needles 16 and in this way, the rotational lock is transferred, so to speak, form the annular surface 12 to the needles 13.

The outer end faces 10 of the piston 6 are also shaped partially cylindrically such that they are complementary to the bore 3 of the outer section 2. Thus, the inner element 4 in the uncoupling state is guided by the piston 6 precisely in the bore 3 of the outer section 2.

LIST OF REFERENCE SYMBOLS

1 Switching element
2 Outer section
3 Bore
4 Inner element
5 Lost-motion spring elements
6 Piston
7 Bore
8 Annular groove
9 Underside
10 End face
11 Transversal surface
12 Annular surface
13 Rotational lock
14 End face
15 Stop elements
16 Needle
17 Recess
18 Helical spring
19 End
20 Pocket hole

The invention claimed is:

1. Switching element for a valve drive of an internal combustion engine, for deactivating a valve, comprising an outer section, in addition to an inner element that can be axially displaced in a bore of the outer section, wherein the outer section and the inner element are displaced away from one another by action of lost-motion spring elements and can be coupled together in an axially-distant relative position, whereby at least one piston, which is situated in a bore that runs transversally through the inner element, acts as a coupling element, wherein an annular groove, into which the piston can be partially displaced to adopt a coupling position, is located in the bore of the outer section, and at least some sections of an underside of the piston have a flat transversal surface, which leads from a outer radial end face of the piston and acts as a contact zone for an opposing annular surface of the annular groove, the piston is held in the inner element by a rotational lock, and stop elements are allocated to an inner radial end face of the piston for an uncoupling position of the piston, and the rotational lock and the stop elements are formed from one component formed as at least one engagement body comprising a needle, which extends offset relative to the bore in a circumferential direction in the inner element, and projects inwards into the bore to form the stop elements for the inner radial end face of the at least one piston, and the inner radial end face, at least on a side of the needle, has a recess complementary to the needle to form the rotational lock, and the bore is provided in the inner element as a radial bore, and the at least one piston includes two pistons that are provided as coupling elements, which are diametrically opposite in the bore, and the needle penetrates the bore centrally, offset by 90° to the bore.

2. Switching element according to claim 1, wherein the recesses of the pistons surround the needle with clearance by complete engagement during the uncoupling position, wherein the component is formed such that when the pistons are displaced into the uncoupling position, directly before one end disengages from the annular groove of the outer section, the recesses at least already slightly surround the needle.

3. Switching element according to claim 1, wherein a total of two of the needles offset by 180° relative to each other are provided.

4. Switching element according to claim 1, wherein the pistons can be displaced into the coupling position by a force of a mechanical spring element inserted with one end into a pocket hole of the inner end face of the pistons.

5. Switching element according to claim 1, wherein the inner element is guided in the outer section so that it can rotate freely.

6. Switching element according to claim 1, wherein the outer end faces of the pistons are complementary to the bore (3) of the inner element (4), at least in a section of a relative displacement path to each other.

7. Switching element according to claim 1, wherein the switching element (1) is formed as a cam follower for a push rod drive.

* * * * *